US008636444B2

(12) United States Patent
Currivan

(10) Patent No.: US 8,636,444 B2
(45) **Date of Patent: *Jan. 28, 2014**

(54) FLUID DISTRIBUTION SYSTEM

(76) Inventor: Frank Currivan, Riverside, CT (US)

( * ) Notice: Subject to any disclaimer, the term of this patent is extended or adjusted under 35 U.S.C. 154(b) by 61 days.

This patent is subject to a terminal disclaimer.

(21) Appl. No.: 13/220,263

(22) Filed: Aug. 29, 2011

(65) Prior Publication Data

US 2012/0057934 A1 Mar. 8, 2012

Related U.S. Application Data

(63) Continuation-in-part of application No. 12/291,096, filed on Nov. 6, 2008, now Pat. No. 8,007,201, which is a continuation-in-part of application No. 11/894,934, filed on Aug. 22, 2007, now abandoned, and a continuation-in-part of application No. 11/523,486, filed on Sep. 19, 2006, now abandoned, which is a continuation-in-part of application No. 11/235,405, filed on Sep. 26, 2005, now Pat. No. 7,384,212.

(51) Int. Cl.
*E02B 11/00* (2006.01)
*E02B 13/00* (2006.01)

(52) U.S. Cl.
USPC ..... 405/43; 405/45; 405/46

(58) Field of Classification Search
USPC ..... 405/36, 43–50, 52, 53
See application file for complete search history.

(56) References Cited

U.S. PATENT DOCUMENTS 848,279 A 3/1907 Ashley
956,665 A 5/1910 Ashley
2,397,655 A 4/1946 Francis
3,220,194 A 11/1965 Lienard
3,401,526 A 9/1968 Rodgers, III
3,645,100 A 2/1972 La Monica
3,680,704 A 8/1972 Schaefer
3,820,341 A 6/1974 Richard et al.
4,013,559 A 3/1977 Johnson
4,065,925 A 1/1978 Auriemma
4,102,135 A 7/1978 Auriemma
4,145,157 A 3/1979 Lascelles
4,183,696 A 1/1980 Auriemma
4,192,628 A 3/1980 Gorman
4,246,305 A 1/1981 Delattre
4,313,692 A 2/1982 Johnson
4,588,325 A 5/1986 Seefert
4,662,778 A 5/1987 Dempsey
4,759,661 A 7/1988 Nichols et al.
4,824,287 A 4/1989 Tracy
4,880,333 A 11/1989 Glasser et al.
4,904,112 A 2/1990 McDonald
4,904,113 A 2/1990 Goddard
4,948,295 A 8/1990 Pramsoler
5,015,123 A 5/1991 Houck et al.
5,017,040 A 5/1991 Mott (Continued)

*Primary Examiner* — Frederick L Lagman

(74) *Attorney, Agent, or Firm* — Ohlandt, Greeley, Ruggiero & Perle, LLP

(57) ABSTRACT

A modular or integral appendage for a septic gallery or conduit has a first section for connected to a lateral side of the gallery with the first section having a number of apertures thereon. The first section has a first area. The lateral side of the septic gallery has a second area. The first area is greater than the second area for increased drainage and thus adds capacity to the gallery or conduit. The second area has protuberances thereon.

33 Claims, 20 Drawing Sheets

(56) References Cited

U.S. PATENT DOCUMENTS

| | | | | |
|---|---|---|---|---|
| 5,017,042 | A | 5/1991 | Minor | |
| 5,129,758 | A | 7/1992 | Lindstrom | |
| 5,401,116 | A | 3/1995 | Nichols | |
| 5,441,363 | A | 8/1995 | Gray | |
| 5,498,104 | A | 3/1996 | Gray | |
| 5,511,903 | A | 4/1996 | Nichols et al. | |
| 5,556,231 | A | 9/1996 | Sidaway et al. | |
| 5,588,778 | A | 12/1996 | Nichols et al. | |
| 5,597,264 | A | 1/1997 | Laak | |
| 5,639,364 | A | 6/1997 | Houck | |
| 5,752,784 | A | 5/1998 | Motz | |
| 5,810,509 | A | 9/1998 | Nahlik, Jr. | |
| 5,887,625 | A | 3/1999 | Takahashi | |
| 5,890,837 | A | 4/1999 | Wells | |
| 5,890,838 | A | 4/1999 | Moore, Jr. et al. | |
| 5,921,711 | A | 7/1999 | Sipaila | |
| 5,951,203 | A | 9/1999 | Laak | |
| 5,954,451 | A | 9/1999 | Presby | |
| 5,989,416 | A | 11/1999 | Gorton | |
| 5,997,735 | A | 12/1999 | Gorton | |
| 6,048,131 | A | 4/2000 | Laak | |
| 6,076,993 | A | 6/2000 | Gray | |
| 6,267,882 | B1 | 7/2001 | Houck et al. | |
| 6,270,661 | B1 | 8/2001 | Jowett | |
| 6,312,248 | B2 | 11/2001 | Lopez | |
| 6,361,248 | B1 | 3/2002 | Maestro | |
| 6,443,652 | B1 | 9/2002 | Houck et al. | |
| 6,485,647 | B1 | 11/2002 | Potts | |
| 6,531,063 | B1 | 3/2003 | Rose | |
| 6,612,777 | B2 | 9/2003 | Maestro | |
| 6,659,687 | B1 | 12/2003 | Donlin | |
| 6,679,653 | B1 | 1/2004 | DiTullio | |
| 6,854,925 | B2 | 2/2005 | DiTullio | |
| 6,869,533 | B2 | 3/2005 | Norgaard | |
| 7,226,241 | B2 * | 6/2007 | DiTullio | 405/46 |
| 7,300,226 | B1 * | 11/2007 | Maestro | 405/46 |
| 7,374,670 | B2 | 5/2008 | Potts | |
| 7,384,212 | B2 | 6/2008 | Currivan | |
| 8,007,201 | B2 * | 8/2011 | Currivan | 405/43 |
| 2002/0044833 | A1 | 4/2002 | Kruger | |
| 2004/0253054 | A1 | 12/2004 | Atchley | |
| 2005/0269253 | A1 | 12/2005 | Potts | |
| 2006/0182497 | A1 | 8/2006 | Potts | |
| 2006/0272988 | A1 | 12/2006 | Potts | |

* cited by examiner

FLUID DISTRIBUTION SYSTEM

CROSS-REFERENCE TO RELATED APPLICATIONS

This application is a continuation-in-part of U.S. application Ser. No. 12/291,096, filed on Nov. 6, 2008, now U.S. Pat. No. 8,007,201, which is a continuation-in-part of U.S. application Ser. No. 11/894,934, filed on Aug. 22, 2007, now abandoned, and is a continuation-in-part of U.S. application Ser. No. 11/523,486, filed on Sep. 19, 2006, now abandoned, which is a continuation-in-part of U.S. application Ser. No. 11/235,405, filed on Sep. 26, 2005, now U.S. Pat. No. 7,384,212.

BACKGROUND OF THE INVENTION

1. Field of the Invention

The present disclosure relates to a distribution system for handling wastewater from septic systems to distribute such wastewater into the surrounding soil or leaching field. The present invention more particularly relates to a distribution system that increases the effluent holding capacity of an existing or new septic system and the ability of such septic system to disperse effluent into the surrounding leaching field. The present disclosure still more particularly relates to a modular or unitary fluid distribution system that increases exposure of effluent in a septic system to the surrounding leeching field to facilitate dispersion of effluent into such field.

The fluid distribution system has broad applicability to any system in which waste water, effluent or runoff from a building, is to be collected and dispersed into a leaching field in the ground.

2. Description of the Related Art

Septic systems are well known in the art. One such septic system is disclosed in U.S. Pat. No. 4,759,661 to Nichols, et al. (hereinafter "Nichols"). Nichols discloses a leaching system conduit made from a thermoplastic member having lateral sidewalls with a number of apertures. The thermoplastic member is an arch shaped member in cross section and has the apertures for the passage of liquid therethrough. The lateral sidewalls also have a number of corrugations formed in a rectangular shaped manner.

Such septic systems are deficient in their operation. First, zoning ordinances for certain sized homes require larger septic systems. Such larger septic systems may not fit on the desired building lot. A large number of bedrooms in a new home construction require, according to some zoning laws, that a certain sized septic system be used or that the certain sized septic system have a predetermined volume. This can be problematic under certain circumstances because the desired septic system may not fit in a certain lot and the new home owner may be limited to only a second sized septic system that is less than desired. With this smaller septic system, the new home builder thus must reduce the size of the new home. Second, in other circumstances homeowners may wish to expand the capacity of the septic system in a retrofit manner from a first size to another second larger size to accommodate a larger home.

However, a known problem in the art is that under this arrangement, the second larger sized septic system, such as Nichols' leaching system, will require the homeowner to excavate the leaching system and remove the leaching system. Thereafter, the homeowner will have to remove additional soil and dirt and then insert a new second sized larger septic system. Further, the homeowner may have to perform additional work to the home to accommodate the home with this replacement and further obtain all of the requisite permits and variances to the zoning laws.

Accordingly, there is a need for at least one modular component that connects to an existing fluid chamber of a septic system that increases an amount of holding capacity of effluent and permits rapid dispersion of such effluent into the surrounding leaching field. The at least one modular component can be attached to an existing septic system of a house to accommodate more living area in such a house, such as an addition. There is also a need for a septic system that does not require replacement of the entire septic system when additional capacity in such system is needed. There is a further need for a septic system to which modular components can be connected to expand the holding and dispersion capacity of such septic system. There is a further need for a septic system that is entirely unitary and has a smaller foot print.

There is also a need for such a system that eliminates one or more of the aforementioned drawbacks and deficiencies of the prior art.

SUMMARY OF THE INVENTION

The present disclosure provides for a fluid dispersion system for an existing septic system for a residential home or commercial building that increases a surface area for dispersion of fluid from the collection chamber into the surrounding leeching field.

The present disclosure also provides for a fluid dispersion system that can be connected in a modular fashion to a fluid collection chamber of existing septic system.

The present disclosure further provides for a fluid dispersion system that increases a surface area on a lateral side of a fluid collection chamber of an existing septic system.

The present disclosure yet further provides for a fluid dispersion system that includes a device that adds capacity to a fluid collection chamber of an existing septic system.

The present disclosure still further provides for a septic system in which a storage capacity of effluent can be increased without substantially increasing the footprint of the collection chamber beneath the ground.

The present disclosure yet still further provides for a septic that has a baffling arrangement on a lateral side for an increased interface with ground, and in particular, an increased interface between a lateral side of the baffling arrangement and the ground.

The present disclosure also provides for a septic system that has a prism, three-dimensional trapezoidal or parallel piped baffling arrangement on a lateral side of an existing system for an increased interface with soil in the surrounding leeching field.

The present disclosure further provides for a septic system that has a prism, three-dimensional trapezoidal or parallel piped baffling arrangement having protuberances on the surface thereof.

The present disclosure still further provides for a septic system that is a unitary septic system having either a prism, three-dimensional trapezoidal or parallel piped baffling arrangement on opposite sides of a narrow pipe or a rectangular gallery to increase ability of pipe or gallery to readily disperse effluent into a surrounding leeching field.

The present disclosure yet further provides for a septic system that is a unitary septic system having a plurality of rectangular or parallel piped shaped members in the baffling arrangement on opposite sides of a narrow pipe or a rectangular gallery.

The present disclosure yet still further provides for a septic system that is a unitary septic system having a plurality of parallel piped shaped members in the baffling arrangement on opposite sides of a fluid collection chamber in which the parallel piped members each have a modular configuration for ease of assembly.

The present disclosure further provides for a septic system that is a unitary septic system having either a plurality of parallel piped shaped members disposed on opposite sides of an effluent chamber or on opposite sides of a modular conduit for increased storage capacity for effluent and enhanced dispersion into surrounding leeching field.

The present disclosure also provides for a dispersion system for a residential home or commercial building in which water is collected for dispersion beneath the soil.

A modular system for a fluid collection chamber installed in the ground and for dispersion of fluid is provided. The fluid collection chamber has a first lateral side with a second surface area and a second lateral side with a third surface area. The modular appendage includes a first modular section for connection to the first lateral side of the chamber. The first modular section includes a first surface having portions that are coplanar and perpendicular to the lateral side and form a plurality of shaped members. The first surface has a first surface area greater in value than the second surface area of the fluid collection chamber.

These and other objects and advantages of the present disclosure are achieved by a septic system of the present disclosure. The system has a modular appendage for a septic gallery and the appendage has a first modular section for connection to a lateral side of the effluent chamber or modular conduit with the first modular section having apertures thereon.

DETAILED DESCRIPTION OF THE INVENTION

Figure 1A:
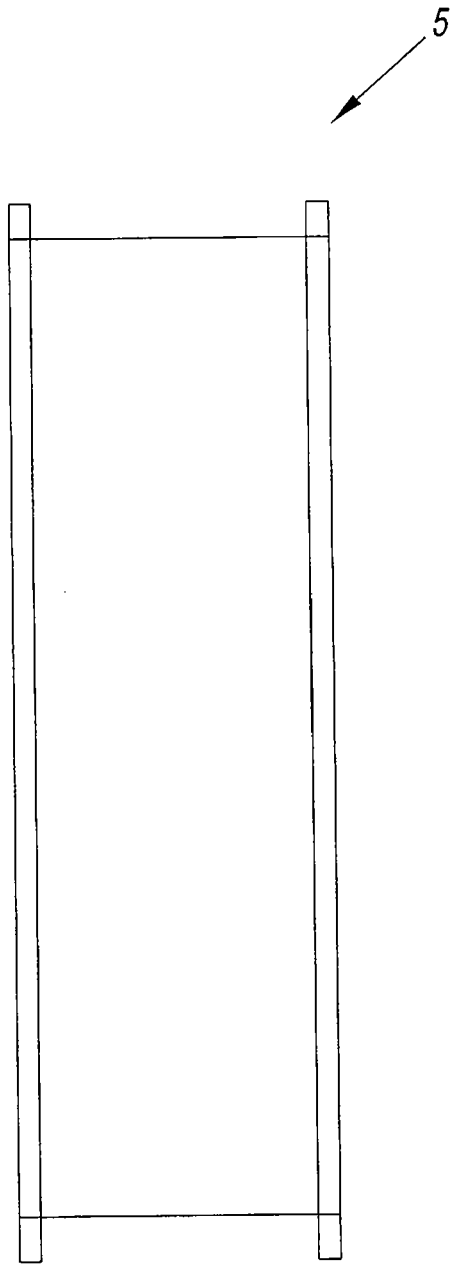
FIG. 1a (Prior Art)
FIG. 1*a* is a prior art septic gallery.

Referring to drawings and, in particular, FIG. 1*a*, there is shown a fluid collection chamber or septic gallery generally represented by reference numeral 5 as is known in the art. The septic gallery 5 is preferably a container that is placed in a leaching field, such as ground or sand, and is utilized for drainage of effluent. Effluent is a term commonly used for waste materials such as liquid and solid industrial refuse or liquid and solid residential sewage that flows out of a source and is discharged into the environment. The effluent is carried from a source such as a bathroom to a septic tank and then to gallery 5 that is located in the leaching field for dispersion, diffusion, or percolation, into surrounding soil.

Known pipes carry the effluent discharge and release the material into a chamber, or vault such as the gallery 5. The gallery 5 as is known will have a number of perforation or holes leading from the gallery 5. The gallery 5 is usually buried in a trench to facilitate dispersion of the effluent into the soil. All of the solid effluent stays in the septic tank, and only the liquid and liquid effluent diffuses into the sand.

In some systems, the gallery 5 is defined by a large diameter perforated conduit. In other systems, the gallery 5 is perforated to provide direct dispersion into the sand. The effluent is then dispersed into the soil either through the soil serving as the floor of the gallery 5 or, when effluent accumulates in the gallery, through passages in side walls thereof.

One known problem in the art is that the interface between the gallery 5 and the ground only allows for a finite flow or dispersion rate of liquid waste from the gallery to the soil or sand on the other side. The interface between the gallery 5 and the ground is a flat surface through which effluent is dispersed to the leaching field. The inventor of the present disclosure has recognized this known problem and has solved the problem with the present disclosure that has a number of unexpected benefits that increase a capacity for liquid waste of the gallery 5, and allows an increased amount of liquid and liquid waste to diffuse into the ground from the gallery.

A prior art septic gallery 5 is commonly concrete or formed of plastic resin material and corrugated for strength. This gallery 5 is formed in sections that are mated to vary the effective length of the leach field. Sometimes multiple galleries 5 are connected to one another to increase the length and capacity of the leaching field, for example a home.

Figure 1B:
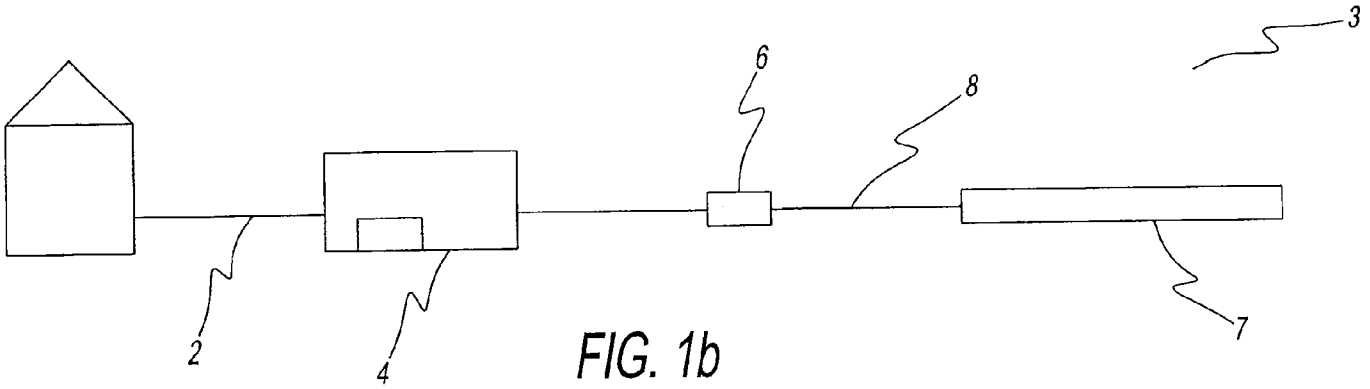
FIG. 1b (Prior Art)
FIG. 1*b* is a prior art anaerobic septic system that treats effluent anaerobically.

Referring to FIG. 1*b*, a known aerobic system for treating effluent aerobically is shown and referenced by reference numeral 3. System 3 shows a pipe 2 that carries solid and liquid waste from house, a tank 4 that receives the waste and a distribution box 6 and a dispersion device 7. All system components are connected via distribution pipe or lines 8. Tank 4 includes a pump that introduces air into tank 4 and increases the amount of aerobic bacteria in tank 4. Effluent that leaves tank 4 is completely treated by system 3 and is dispersed into surrounding leaching field by dispersion device 7.

Figure 1C:
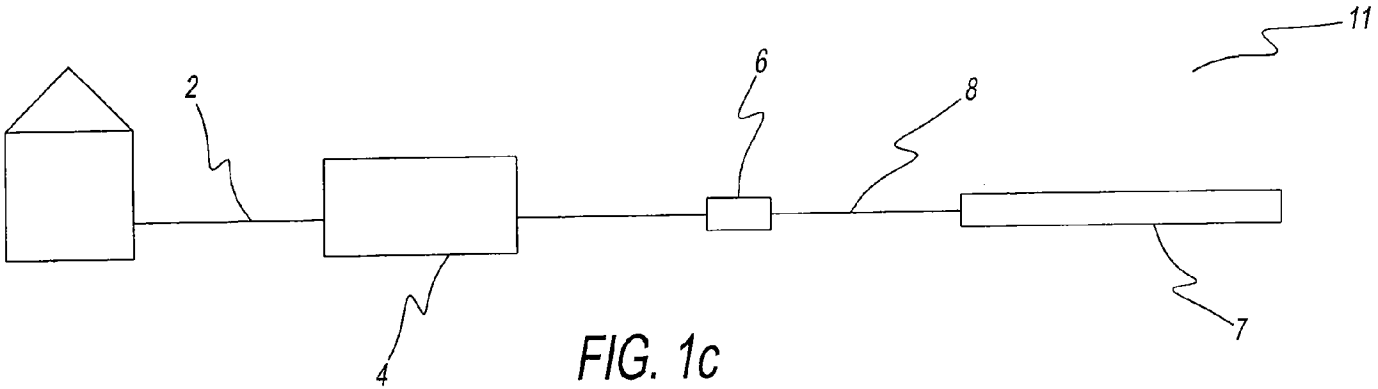
FIG. 1c (Prior Art)
FIG. 1*c* is a prior art aerobic septic system that treats effluent aerobically.

Referring to FIG. 1*c*, conventional system 11 has substantially the same elements as system 3 except that tank 4 does not include pump for introducing air, particularly oxygen, into tank 4. In contrast, tank 4 separates water from solids and passes untreated contaminated water via distribution line 8 to be dispersed in leaching field via dispersion device 7. Once contaminated water leaves dispersion device, such contaminated water is treated anaerobically by anaerobic bacteria in leaching field.

Figure 2A:
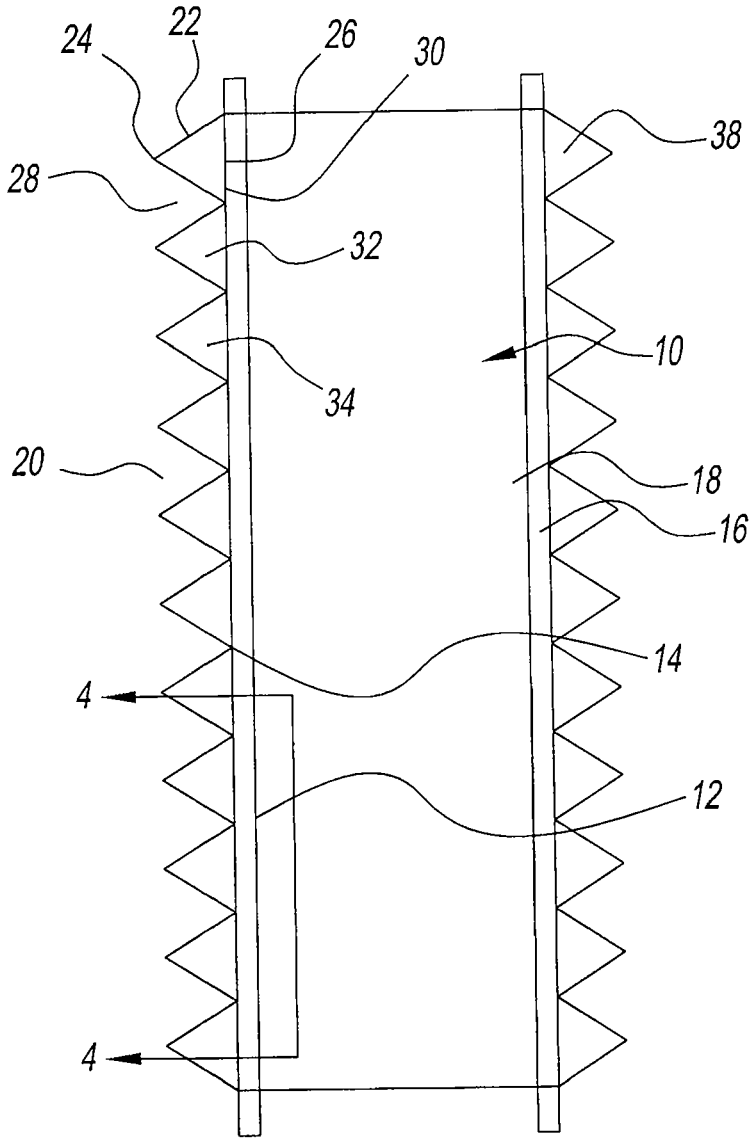
FIGS. 2*a* and 2*b* is a top plan view of the appendages of the present disclosure connected to a septic gallery.

Referring to FIG. 2*a*, there is shown the septic gallery 10 buried beneath the ground according to the present disclosure. The gallery 10 is preferably connected to an effluent source, and has a first conduit 12 or pipe that is connected to a septic tank or pump chamber (not shown). In one embodiment, the gallery 10 has a four foot width although galleries can be provided in a variety of standard and/or conventional sizes to accommodate homes and or properties of differing sizes. The gallery 10 preferably has a first conduit 12 on a first side 14 of the gallery, and a second conduit 16 on a second side 18 of the gallery. The conduit or conduits can also attach to the gallery. The effluent is in a liquid form and preferably enters the gallery 10 from the first conduit 12 and the second conduit 16 to fill the gallery over time to capacity. Capacity is the number of gallons of effluent and depends on the size of the residence or waste source above ground. After a period of time, prior art galleries becomes filled with liquid effluent, and must be replaced.

The present disclosure provides for a fluid dispersion system that increases both storage capacity of the septic gallery or fluid collection chamber and a dispersion capability of such gallery by providing a fluid dispersion system. Most preferably, the present disclosure achieves this need in an unexpected manner.

The gallery 10 has a first appendage 20 on the first lateral side 14 of the gallery 10, according to the present disclosure. Preferably, the first appendage 20 contacts the ground or sand in the ground contacting side, and also communicates with the first conduit 12 on the first side 14 of the gallery opposite the ground contacting side. The surrounding earth or sand presses appendage 20 to gallery 10 and maintains such appendage against the gallery. Alternatively, the appendage 20 and the gallery 10 may be formed as one integrated structure or as separate discrete pieces. The first appendage 20, in one embodiment, may be permanently connected to the gallery 10 by a connector. Alternatively, the first appendage 20 may be a modular member that is removably connected to the gallery 10, for easier replacement thereof or easier addition to the gallery for enhanced septic capability.

Preferably, the first appendage 20 has a number of shaped members, or baffles, to permit enhanced diffusion of the effluent into the ground from the first appendage 20. The first appendage 20 has number of shaped members to permit diffusion into the ground from the gallery 10 in a rapid manner. Preferably, the first appendage 20 has a number of prism or triangular shaped members generally represented by reference numeral 22 with each having an apex 24 and a base portion 26. The three-sided members could have a rounded tip. The shaped members 22 collectively preferably form a baffle. Each member 22 is preferably a triangular member having two equal sides to form a substantially isosceles triangle. However, each member 22 can be a substantially equilateral triangle in which each angle includes approximately 60 degrees. Still further, each member 22 may be any three-sided member. Each member 22 is made from a material capable of withstanding the environment of the septic tank and gallery, such as, for example, a plastic resin material that would include resilient thermoplastic, polycarbonate, polyvinyl chloride (PVC), achrilonitride-butadiene-styrene (ABS), polyurethane, or acrylic resin.

In one non-limiting embodiment, the base portion 26 has a width of about one foot. A diffusion space 28 is formed between a first triangular member 30 and a second triangular 32 member of the baffle 22. Baffle 22 may contain a plurality of triangular members 30, 32 for diffusion into surrounding soil. The diffusion space 28 is also triangular shaped and is preferably allowed to fill in with an acceptable ground contacting material such as sand, gravel, or any combination thereof, for diffusion. Likewise, a second diffusion space 28 is formed between the second triangular member 32 and a third triangular member 34. This structure continues along the length of the gallery 10. A similar configuration is possible for the three-dimensional trapezoidal shaped appendages, in which successive trapezoidal shaped appendages have a trapezoidal or triangular space therebetween.

Figure 3:
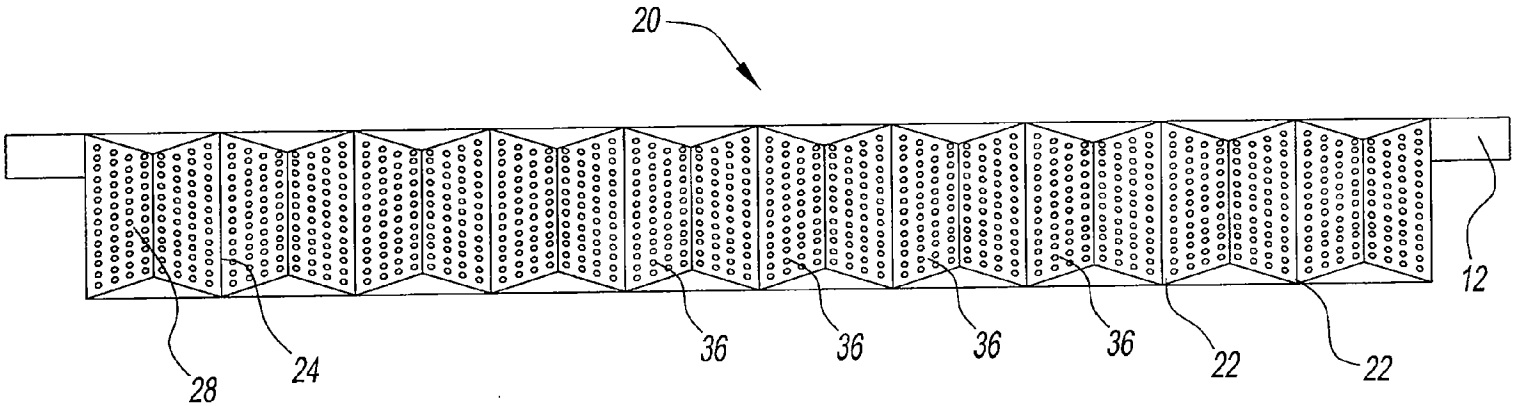
FIG. 3 is a front view of the appendage for the septic gallery.

Referring to FIG. 3, there is shown the baffle 22 with the diffusion spaces 28. The baffle 22 has a number of apertures 36 thereon. The liquid effluent preferably traverses through the apertures 36 and then diffuses into the soil, sand, gravel, or ground. The baffle 22 preferably increases a surface area of the lateral side of the first appendage 20 of the gallery 10 to allow an increased amount of liquid effluent to escape from the gallery 10, and traverse through the apertures 36 of baffle 22 and for diffusion to the sand, or soil of leaching field.

Figure 4:
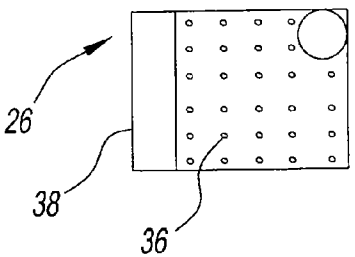
FIG. 4 is a cross-sectional view of the septic gallery taken along line 3-3 of the gallery of FIG. 1.

Referring to FIG. 4, a base portion 26 of each triangular member of the baffle 22 has the apertures 36 in a configuration.

Figure 2B:
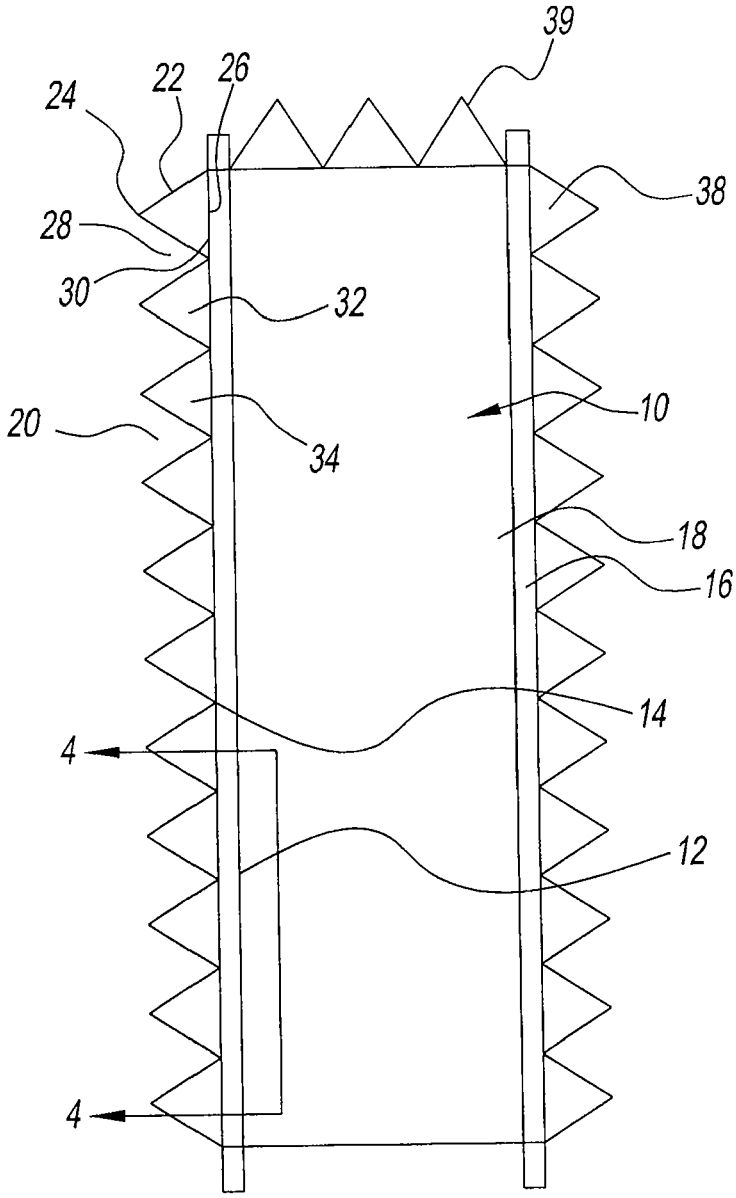

Preferably, the gallery 10 also has a second appendage 38 located on a second side 16 of the gallery as shown in FIG. 1. Additionally, the first and the second appendages 20, 38, respectively, may form modular members to retrofit to an existing septic gallery 10 to increase a capacity thereof. Appendages 20 and 38 can be fabricated to accommodate existing and new galleries. Spaces between first and second appendages 20 and 38, respectively, can be filled with mason sand or any such material that can accept the fluid. Referring to FIG. 2*b*, the gallery 10 could also have an additional third appendage 39 affixed to an end thereof to provide diffusion capability on three sides.

Figure 5:
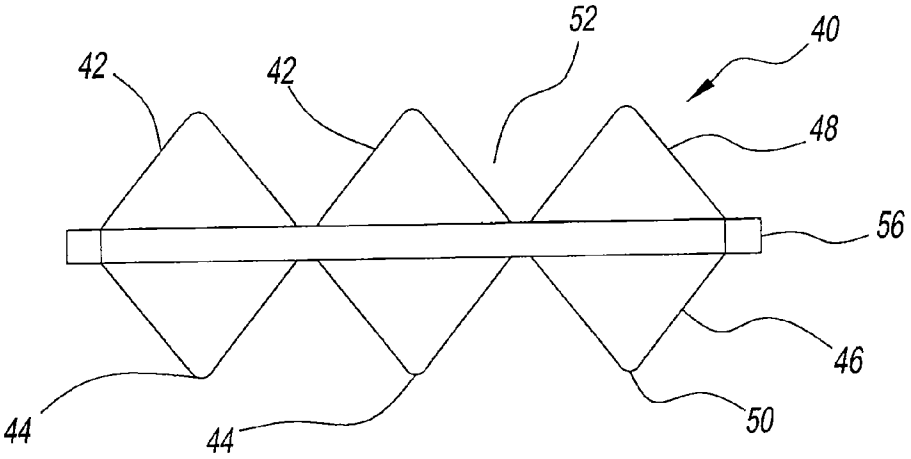
FIG. 5 is a top plan view of two appendages of the present disclosure connected to each other without a septic gallery.
Figure 6:
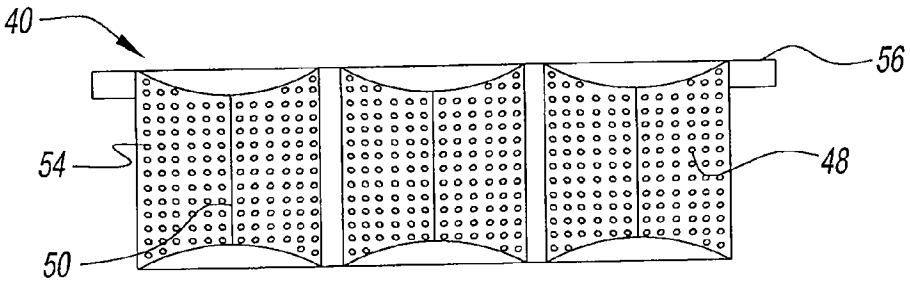
FIG. 6 is a front view of the appendages of FIG. 5 of the present disclosure.

Referring to FIGS. 5 and 6, a second embodiment of an appendage system 40 of the present disclosure is shown. System 40 has two appendages 42 and 44 that are abutting each other. Each appendage 42 and 44 can have any number of triangular elements 46 to form a baffle 48. Each baffle 48 has numerous apertures 54 to allow for passage of effluent into leaching field. Triangular elements 46 can have rounded tips 50 to further increase the surface area of diffusion of liquid into the soil 52 in the leaching field. Baffle 48 preferably increases a surface area of the lateral side of the first appendage 42 and 44 to allow an increased amount of liquid effluent to escape from the appendages and channel 56, and traverse through the apertures and for diffusion to the sand, or ground.

Figure 7:
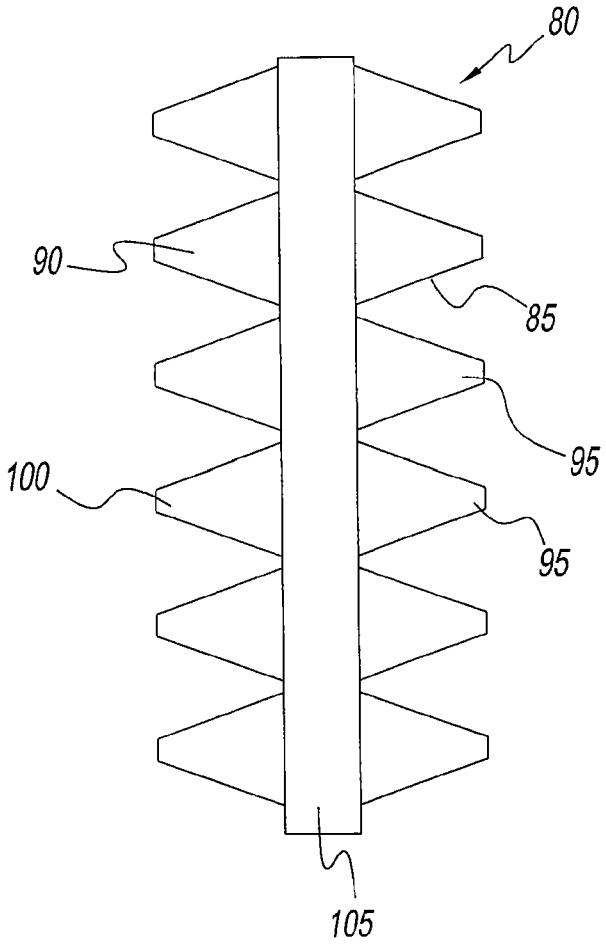
FIG. 7 is a top view of the appendages of a second embodiment of the present invention having trapezoidal appendages on opposite sides of a gallery.
Figure 8:
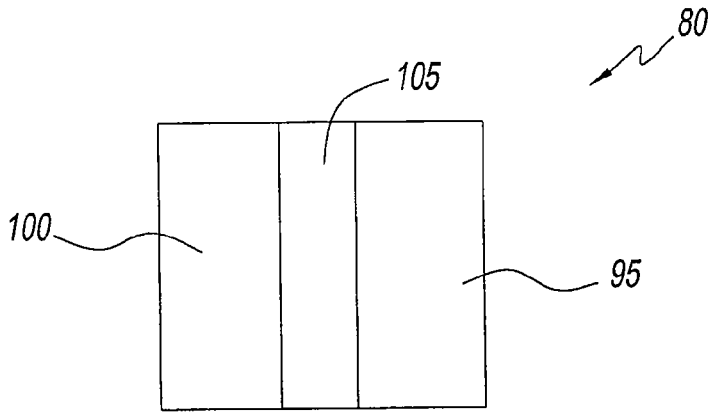
FIG. 8 is a top view of a third embodiment of the present invention having a unitary construction and trapezoidal appendages and a central conduit/pipe.

In a third embodiment of the present disclosure shown in FIGS. 7 and 8, a septic system 80 has an entirely unitary structure. System 80 has a first baffle 85 and a second baffle 90. Each baffle has a plurality of trapezoidal appendages 95 and 100, respectively, integrally connected thereto to form a unitary trapezoidal configuration. A center channel 105 or conduit extends through the center of baffle 85 and facilitates the flow of effluent from source and through appendages 95 and 100. Channel 105 has a relatively small diameter relative to the dimensions of the appendages 95, to maintain a small footprint of the entire system without compromising dispersion capability. Channel 105 has a length of approximately from 6 feet to approximately 8 feet long. The height and width are approximately 1 foot to 4 feet depending upon the required capacity of the system. Appendages 95 and 100 are approximately 1 foot to 3 feet in length away from channel 105. The overall width of conduit 105 together with appendages 95 and 100 is preferable from 4 feet to 6 feet. The unitary configuration permits a high capacity septic system with a small footprint thus minimizing the amount of land required for placement beneath or near a residence or building.

Figure 9:
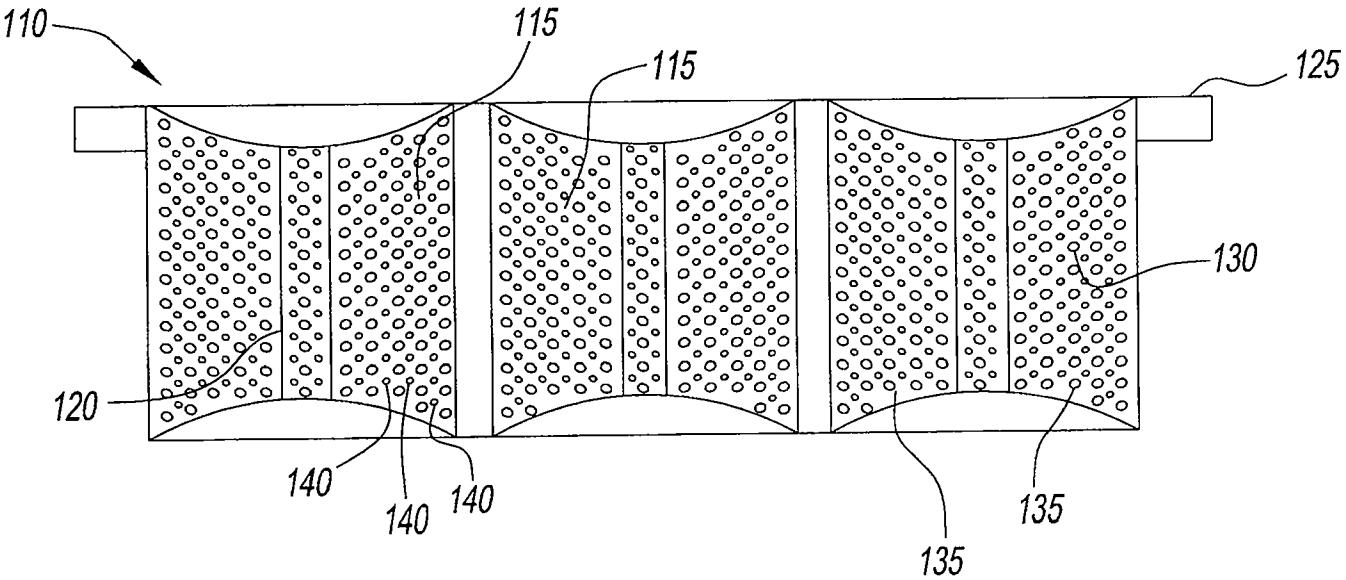
FIG. 9 is a top front view of the embodiment of FIG. 8.
Figure 10:
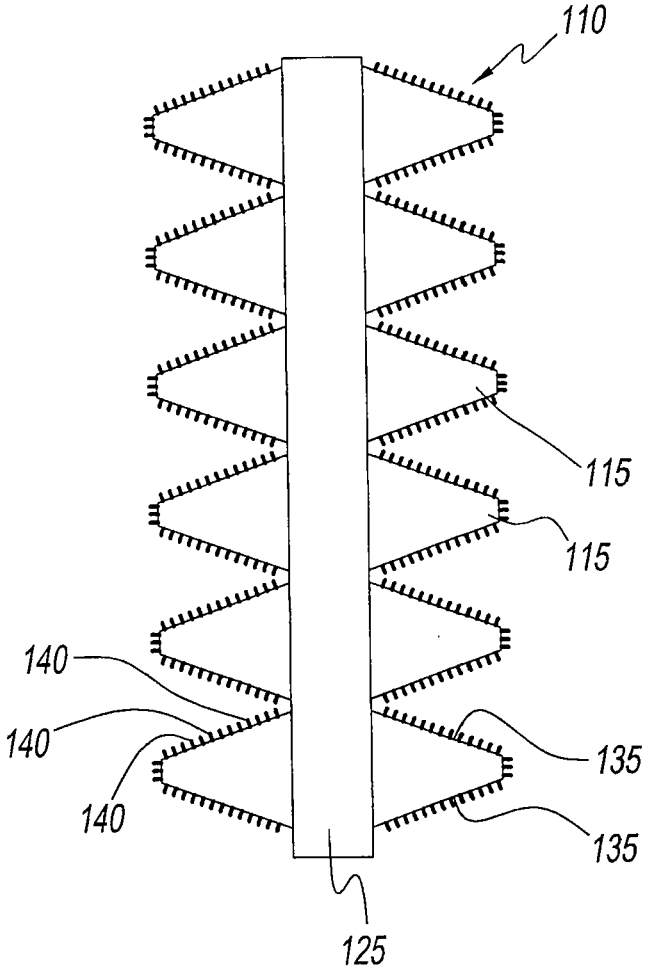
FIG. 10 is a side view of a fourth embodiment of the present invention having a plurality of protuberances on the surface baffle appendages.

In a fourth embodiment, a septic system 110 is shown in FIGS. 9 and 10. Septic system 110 also has a plurality of appendages 115 that each has a flattened tip to form a polygon such as a trapezoid, instead of an apex as shown in the previous embodiment. The plurality of trapezoidal shaped appendages 115 collectively form a baffle 120. Appendages 115 are on opposite sides of gallery 125 to effect the diffusion of effluent. Each appendage 115 has a pattern of holes 130 therethrough to expedite the passage of the effluent into the surrounding soil. In addition to a pattern of holes 130 extending through the appendages surfaces 135, surface 135 also have a plurality of protuberances 140 thereon. Protuberances 140 maintain a distance between the appendage faces 135 and any filter material placed over appendages faces 135. The protuberances 140 extend in a direction perpendicular to the surface of the appendage surfaces 135. The dimensions of protuberances 140 vary from 0.25 inches of 0.50 inches. The dimensions of each appendage 115 vary and can be from one foot to two feet long. The width of each appendage at its base can be approximately 4 inches and taper to approximately 3 inches or any other easily manufactured dimension. Similarly, the length of baffle 120 can vary to meet the necessary septic system capacity. While the present embodiment shows a trapezoid, the appendages 115 could also have a horse shoe shape, triangular shape, or any other shaped configuration that would permit effluent diffusion.

Further, the height of baffle 120 is preferably maximized for more efficient diffusing of effluent. By having a higher baffle 120 in comparison to a longer galley 125 and baffle arrangement, more of the effluent can be diffused through the baffle 120 because more of the effluent is exposed to the contents of the gallery 125. A higher baffle 120 also allows the footprint of septic system 110 to be smaller. While protuberances 140 are shown on appendage faces 135, the protuberances could also project from the surface of appendages 20, 65, 85 and 90. Protuberances 140 are not shown to scale in FIGS. 10 through 15, but are illustrated as being large for purposes of illustration.

Figure 11:
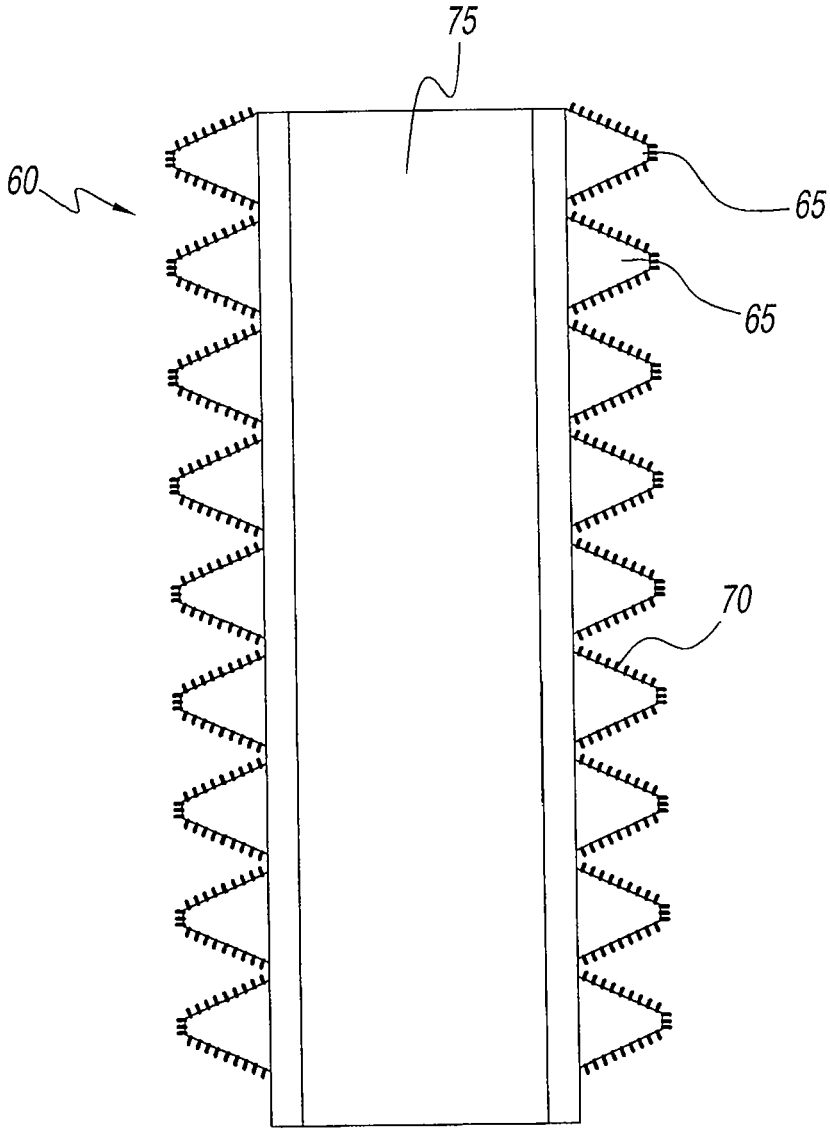
FIG. 11 is a top view of the embodiment of FIG. 10.

In another exemplary embodiment, a system 60 is shown in FIG. 11. Septic system 60 has a relatively broad gallery compared to the conduit 125 of FIG. 10. System 60 has a plurality of appendages 65 that each has a flattened tip to form a trapezoid, instead of an apex as shown in the previous embodiment. The plurality of trapezoidal shaped appendages 65 collectively form a baffle 70. Appendages 65 are on opposite sides of gallery 75 to effect the diffusion of effluent. Each appendage 65 has a pattern of holes therethrough to expedite the passage of the effluent into the surrounding soil. The dimensions of each appendage vary and can be from one foot to two feet long. The width of each appendage at its bases can be approximately 4 inches and taper to approximately 3 inches. Similarly, the length of baffle 70 can vary to meet the necessary septic system capacity. Protuberances may also be present on the facing surfaces of appendages 65 as shown in FIG. 11.

Figure 12:
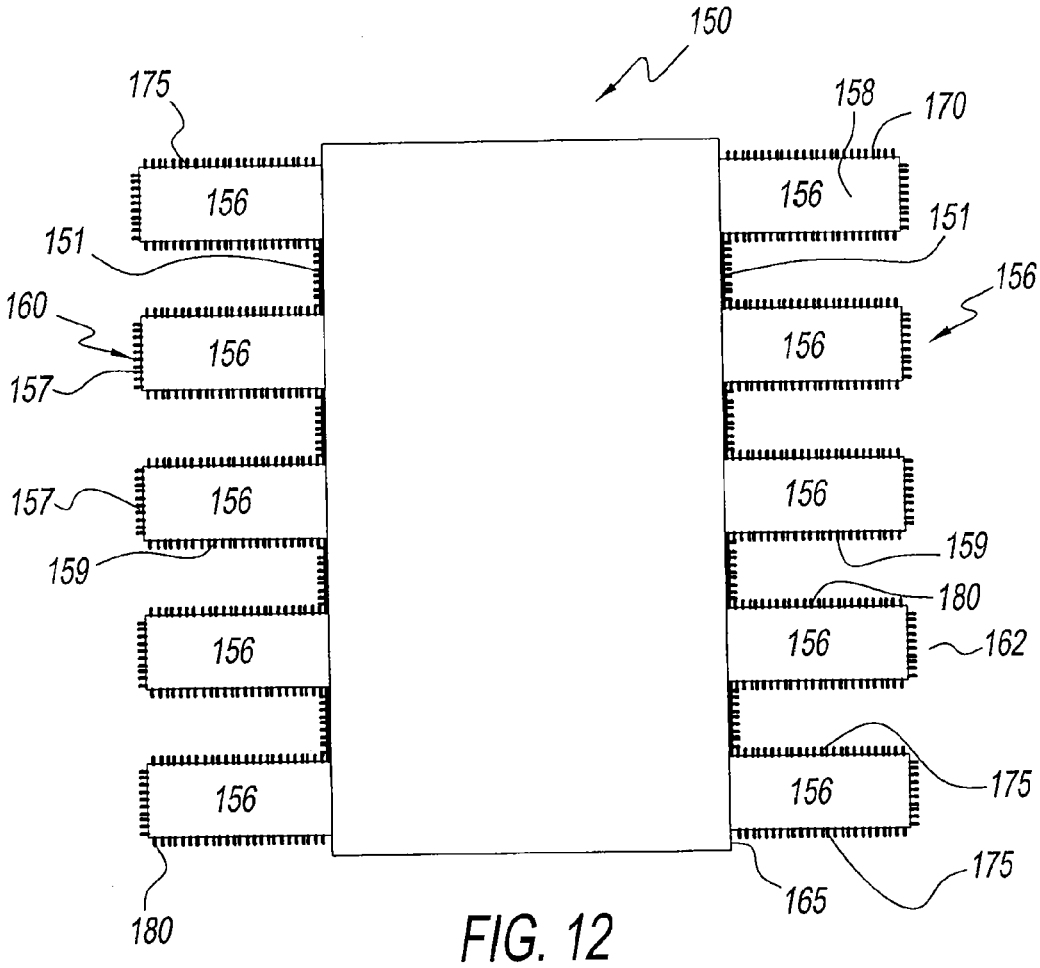
FIG. 12 is a top view of a fifth embodiment of the present invention having a gallery having a plurality of rectangularly shaped appendages and having protuberances thereon.
Figure 13:
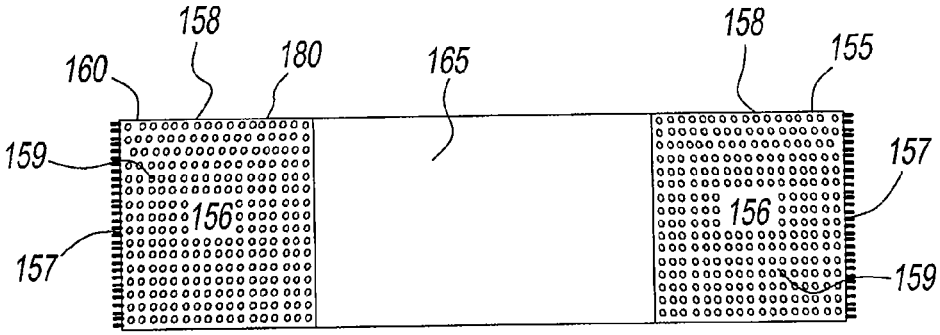
FIG. 13 is a side view of the embodiment of FIG. 12.
Figure 14:
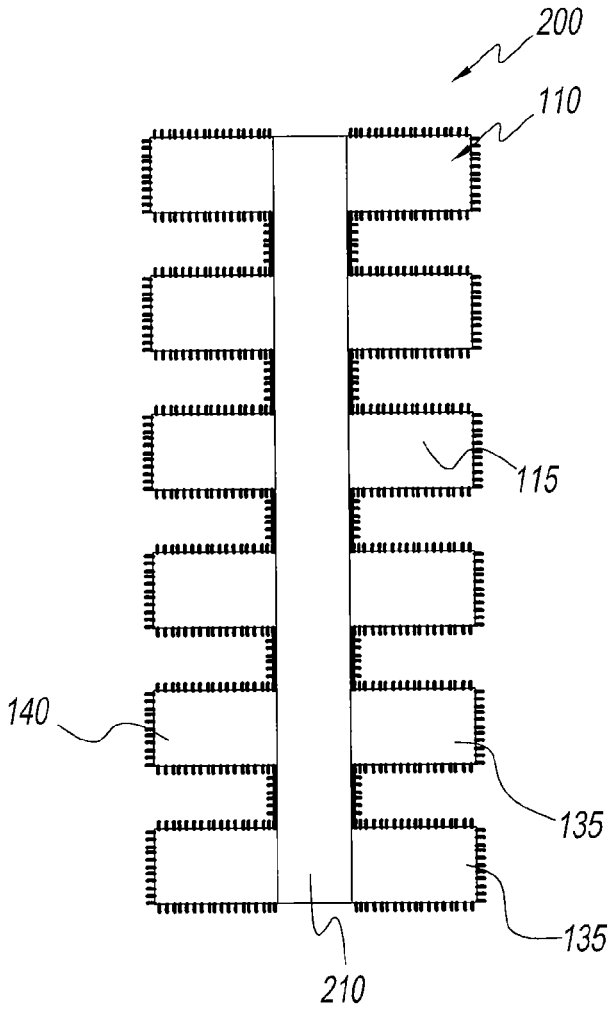
FIG. 14 is a top view of the a configuration of the embodiment of FIG. 12 having a narrow conduit.
Figure 15:
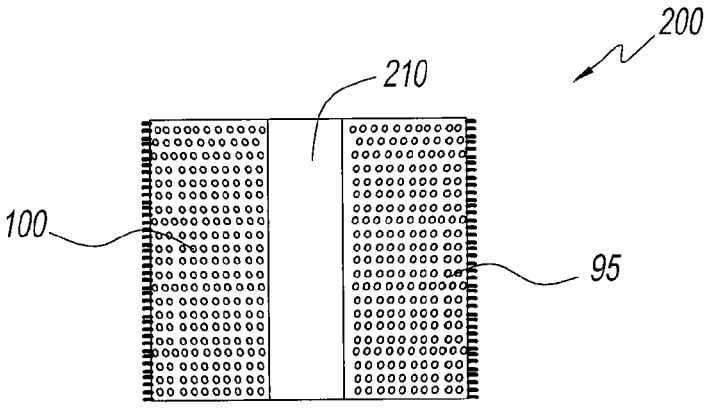
FIG. 15 illustrates a side view of the embodiment of FIG. 14.

In a fifth embodiment, a system 150 is shown in FIGS. 12 and 15. System 150 also has a first appendage 155 and a second appendage 160. Each appendage 155, 160 has a plurality of rectangular appendage members 156 that collectively form a baffle. Appendages 155 and 160 are on opposite sides of gallery 165 to effect the diffusion of effluent therethrough into surrounding leaching field. While FIGS. 12 and 13 show a gallery 165, a conduit or channel 210 can also be used as shown in FIGS. 14 and 15. Members 156 each have a surface 175 and a pattern of holes or apertures 170 extending therethrough on the vertical walls to expedite the passage of the effluent into the surrounding soil. In addition to a pattern of holes 170, appendage surface 175 also has a plurality of protuberances 180. Protuberances 180 maintain a distance between surface 175 and any filter material placed over appendage surface 175. Protuberances 180 are also located on the perimeter of gallery 165. Each member 156 is connected by a connector member 151 that also has a pattern of holes therethrough 170 and protuberances 180 thereon.

In a preferred embodiment of the present disclosure, appendages 155 and 160 are modular members with each having four sides and an open bottom. Appendages 155 and 160 have an open side that faces downward and an open back that faces gallery 165. Each vertical side 159 has a length and a height of approximately one foot and 0.25 to 0.5 inches. Appendages 155 and 160 extend in a direction away from gallery 165 and are perpendicular to gallery 165. Appendages 155 have a facing member 157 that is substantially parallel to side of gallery 165. Facing member 157 has a width of approximately from 5.0 inches to 5.5 inches and a height of approximately one foot and a quarter inch to one foot and a half an inch. Vertical sides 159 each connect to an outward facing surface of gallery 165 in a press fit manner. Facing members 157 also connect in a press fit manner to vertical sides 159. Similarly each member 156 has a top covering member 158 that is connected to each vertical side 159 and facing member 157 in a press fit manner. Top covering member 158 is substantially identical in size to facing member 157. Covering members 158 does not have holes extending therethrough or protuberances 180. Vertical side members 159, facing members 157 and covering member 158 all have a plurality of protuberances 180 that extend over the surfaces thereof. Protuberances 180 extend in a direction perpendicular to the surface vertical side members 159 and facing members 157 of the appendage surfaces 175. The dimensions of protuberances 180 vary from 0.25 inches of 0.50 inches.

By being modular in configuration, members 156 can be pre-assembled before being installed beneath the ground. Additionally, the press-fit configuration permits movement between vertical sides 159, facing members 157 and covering member 158 to limit the possibility of breakage during installation. Further, appendages 155 and 160 can be stacked vertically to increase the diffusion capacity of septic system 150 without impacting the size of the footprint beneath the surface of the ground. Appendages 155 and 160 are made from a material capable of withstanding the environment of the septic tank and gallery, such as, for example, a plastic resin material that would include resilient thermoplastic, polycarbonate, polyvinyl chloride (PVC), achrilonitride-butadiene-styrene (ABS), polyurethane, or acrylic resin.

The length of the overall system 150 is variable depending upon the septic system capacity needs of the residential or commercial property that is being serviced.

The length of each septic system 150 is approximately six feet to eight feet. The height of each appendage 155 and 160 can be from approximately one foot to approximately four feet. This height represents a series of stacked appendages.

Further, the height of appendages 155, 160 are preferably maximized for more efficient diffusing of effluent. By having a higher appendage 155, 160 in comparison to a longer galley 165 and baffle arrangement, more of the effluent can be diffused through the baffle because more of the effluent is exposed to the contents of the gallery 165. A higher baffle also allows the footprint of septic system 150 to be smaller.

Referring to FIGS. 14 and 15, a system 200 having a conduit 210, as opposed to a gallery, is shown. System 200 contains all features and components of the septic system 150 except that the channel or pipe carrying the effluent is much narrower in width. This narrower width permits a much smaller footprint without sacrificing substantial septic capacity.

Referring to FIGS. 12 through 15, the rectangular configuration of members 156 permits a greater surface area exposure of effluent to surrounding media. Others shapes would potentially reduce the surface area for diffusion into surrounding media of leeching field. Additionally, connector members 151 provide even spacing and stability between members 156. Connector members 151 are sized to permit effective diffusion of effluent into surrounding media because the space between members 156 is large enough to accommodate diffusion of effluent.

Figure 16A:
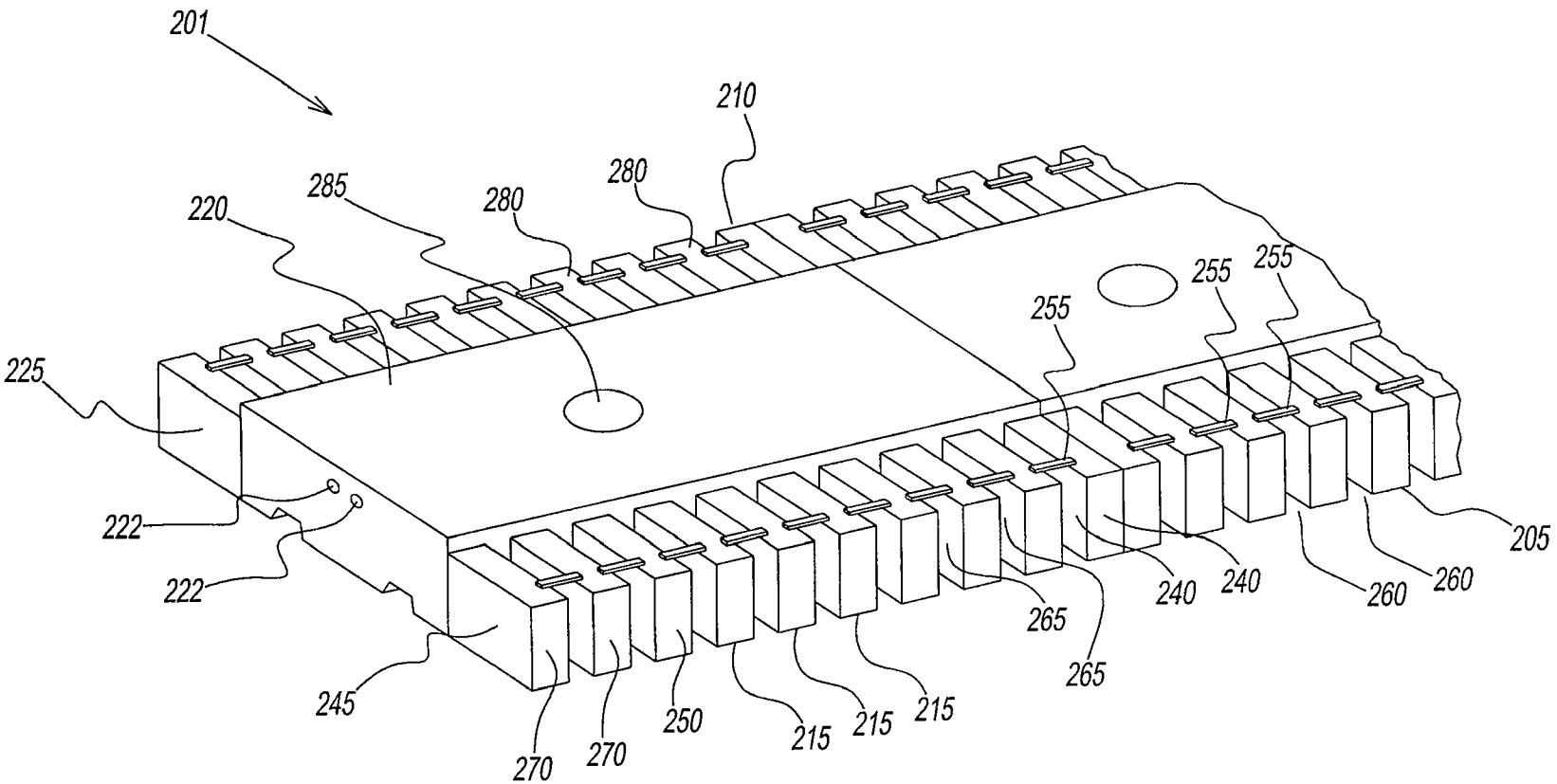
FIG. 16*a* illustrates a top perspective view of a sixth embodiment of the present disclosure.
Figure 16B:
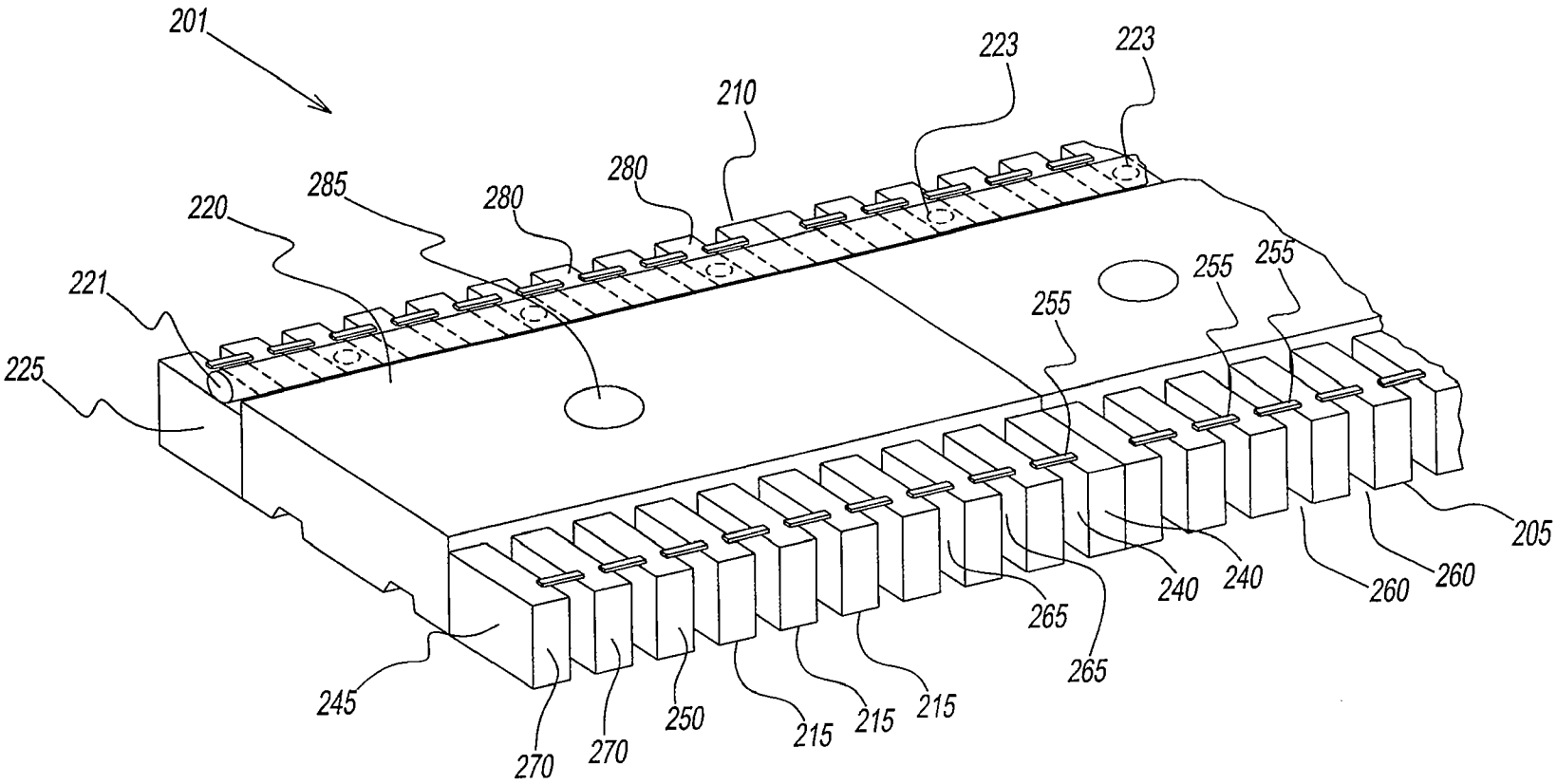
FIG. 16*b* illustrates a top perspective view of the embodiment of FIG. 16*a* in which a pipe directs fluid directly to the dispersion members.
Figure 17:
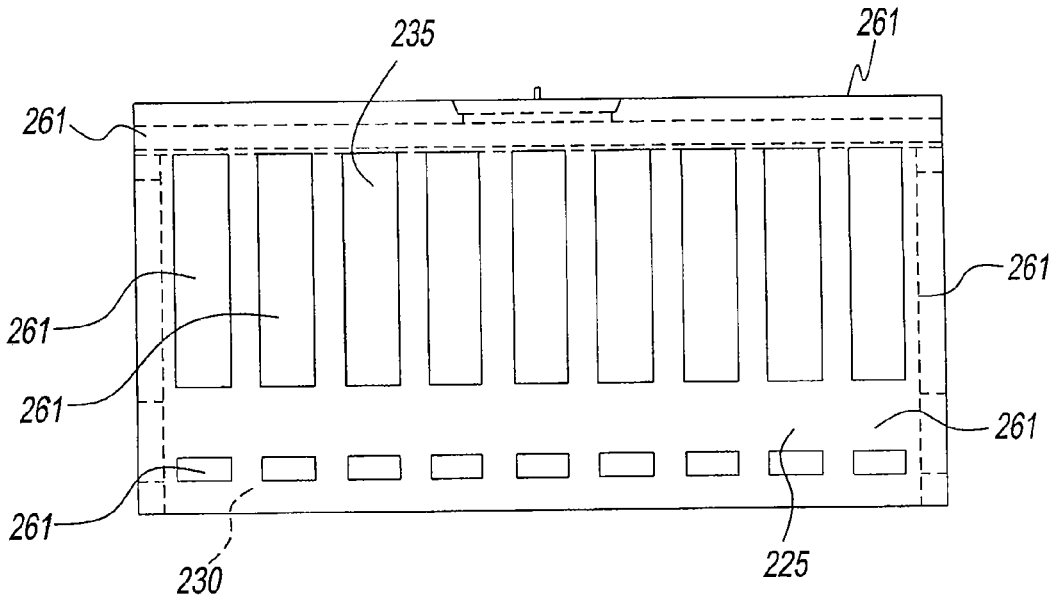
FIG. 17 illustrates a side view of the collection chamber of the embodiment of FIG. 16*a;*

In a sixth embodiment, a system 201 is shown in FIGS. 16*a*, 16*b* and 17. System 201 also has a first appendage 205 and a second appendage 210. Each appendage 205, 210 has a plurality of preferably rectangular appendage members 215 that collectively form a baffle. Appendages 205 and 210 are on opposite sides of a collection chamber 220 to effect the diffusion of effluent to surrounding soil of leaching field.

In FIG. 16*b*, a pipe 221 directs fluid directly into rectangular appendage members 215 from fluid source. In FIG. 16*b*, pipe 221 has apertures on its lower surface and appendage members 215 have opening 223 in the upper surface to establish fluid communication between pipe 221 and appendage members 215 from fluid source. By directing effluent directly into appendage members 215 instead of central gallery, grease particles are able to be separated from effluent as soon and effluent enters system. By eliminating grease particles from effluent, the non-grease effluent can flow into central gallery and prevent clogging and more effectively flow into trench in which gallery and appendage members are placed. In other words, the elimination of grease particles as soon as possible prevents more rapid escape of non-grease effluent into central chamber and surrounding leaching field.

While FIGS. 12 and 13 show a gallery 165, a sixth embodiment discloses a collection chamber 220 in greater detail in FIG. 17. Collection chamber 220 is of variable size and contains integral dosing pipes 222 that extend therethrough to transport the effluent into a system 201. Significantly, collection chamber 220 has lateral sides 225 and 230 that each has large openings 235 extending therethrough. Large openings 235 on lateral sides 225 and 230 directly face first appendage 205 and second appendage 210, respectively, to allow effluent from pipes 222 direct access to appendages 205, 210. Collection chamber 220 does not have the perforations or the holes or pattern of holes in its lateral sides as the galleries of embodiments discussed earlier.

Appendage members 215 each has a surface 240 and a pattern of holes 245 extending therethrough on the vertical walls to expedite the passage of the effluent into the surrounding soil or leaching field. The appendage members 215 are identical to the appendage members 156 of FIGS. 12 through 15. In addition to a pattern of holes 245 therethrough, appendage surface 240 also has a plurality of protuberances 250 thereon. Protuberances 250 maintain a distance between appendage surface 240 and any filter material placed over appendage surface 240. Filter material is placed over the lateral sides of each appendage member 215 to prevent the entry of soil from the leeching field into system 201. Each appendage member 215 is connected by a strap 255 that ensures proper alignment of appendage member 215 during assembly and prior to installation at the site.

Referring to FIGS. 16*a*, 16*b* and 17, base components 260 connect adjacent appendage members 215. Base components 260 prevent appendages 205 and 210, and their appendage members 215 from sinking into surrounding soil in leaching field particularly when soil is saturated with effluent. Base components 260, like straps 255, ensure that proper alignment is maintained between appendages members 215 during assembly and after installation at septic system site. Base components have sides 261 that are secured preferably in a press fit fashion to appendage members 215. Additionally, base components have support surfaces 262 to provide added surface area to septic system 201 to minimize pressure against soil to thereby prevent sinking.

In a preferred embodiment of the present disclosure, appendage members 215 are modular members each having three outwardly facing sides and a top. Appendage members 215 each have an open back that is adjacent effluent chamber 220. Vertical side 265 of each appendage member 215 is from 12 inches to 48 inches in height, although any convenient height could be used. Appendage members 215 are placed one on top of the other to achieve this 48 inch height. The width of a facing side 270 of each appendage is approximately 6 inches to 6.5 inches, and preferably 6.24 inches. The height of each appendage member 215 is approximately 12 inches to 50 inches high. Appendages 205 and 210 extend in a direction away from effluent chamber 220 and are perpendicular to effluent chamber 220. Vertical sides 265, facing sides 270 and chamber 220 connect to one another in a press fit manner. Similarly each appendage member 215 has a top covering member 280 that is connected to sides 265 and 270 in a press fit manner. Covering members 280 do not have holes extending therethrough or protuberances. Vertical side members 275 and facing members 270 all have a plurality of protuberances 180 that extend over the surfaces thereof. Protuberances 180 extend in a direction perpendicular to the surface vertical side members 275 and facing members 270. The dimensions of protuberances 180 vary from 0.25 inches of 0.50 inches.

By being modular in configuration, members 205 and 210 can be pre-assembled before being installed in the ground. Additionally, straps 255 and base components 260 enable easy assembly. Further, the press-fit configuration of adjacent parts permits a degree of relative movement between vertical sides 275, facing members 270, covering members 280 and effluent chamber 220 to limit the possibility of breakage during installation. Further, appendages 205 and 210 can be stacked vertically to increase the diffusion capacity of septic system 201 without impacting the size of the footprint beneath the surface of the ground. Appendages 205 and 210 are made from a material capable of withstanding the environment of the septic tank and gallery, such as, for example, a plastic resin material that would include resilient thermoplastic, polycarbonate, polyvinyl chloride (PVC), achrilonitride-butadiene-styrene (ABS), polyurethane, or acrylic resin. Effluent chamber 220 is preferably made from concrete. Further, effluent chamber 220 has an access or maintenance hole 285 in the top for access, maintenance or inspection.

The length of the overall septic system 201 is variable depending upon the septic system capacity needs of the residential or commercial property that is being serviced. The length of each modular unit of effluent chamber 220 is preferably 8 feet although other lengths could also be used. The height of effluent chamber 220 is approximately one foot to approximately four feet. This height of four feet represents a series of stacked appendages. The width of the effluent chamber 220 is approximately 4 feet.

Figure 18:
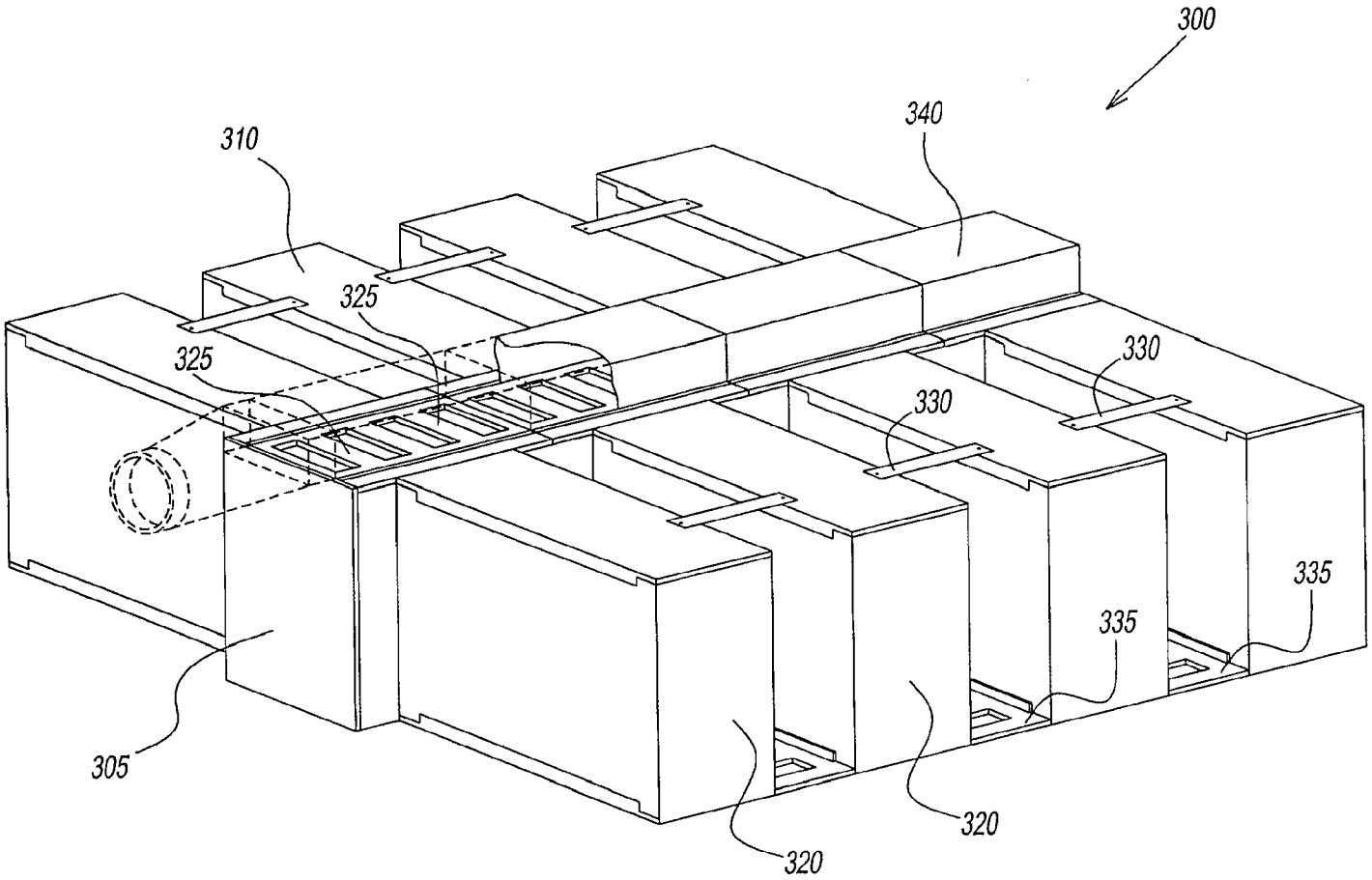
FIG. 18 illustrates a perspective view of a seventh embodiment of the present disclosure.

The seventh embodiment of the present disclosure is entirely modular in configuration, as shown in FIG. 18. A system 300 has a central effluent collection chamber 305 and first and/or second appendages 310 and 315, respectively, on opposing lateral sides of chamber 305. First and second appendages 310 and 315 have appendage members 320 attached thereto to increase the surface area for dispersion of effluent into leaching field. A pipe 340 is disposed to direct effluent into chamber 305.

Central effluent chamber 305 of system 300 typically includes a plurality of body segments 325 that are interconnected to form the entire central effluent chamber 305. Each body segment 325 has one or more openings at its top surface to receive effluent from pipe 340. Similarly, opposing sides of each body segment 325 each have openings from which effluent in each body segment 325 can diffuse into appendage members 320. Each body segment 325 of effluent chamber 305 is preferably approximately 10.5 inches in length and is interconnected to provide the necessary septic capacity depending upon the needs of the building that is being serviced. Body segments 325 can be of variable height and width. Body segments 325 vary from 12 inches to 48 inches in height and vary from 8 inches, 16, to 24 inches in width. While these dimensions are preferable, any dimension of body segment 325 can be configured to yield a volume to accommodate the needs of a particular septic capacity.

Central effluent chamber 305 has connected thereto a first appendage 310 and a second appendage 315, like the sixth embodiment of the present disclosure. Each appendage 310, 315 has a plurality of preferably rectangular appendage members 320 are disposed on opposite sides of effluent chamber 305 to effect the diffusion of effluent therethrough to leaching field surrounding system 300.

Figure 19:
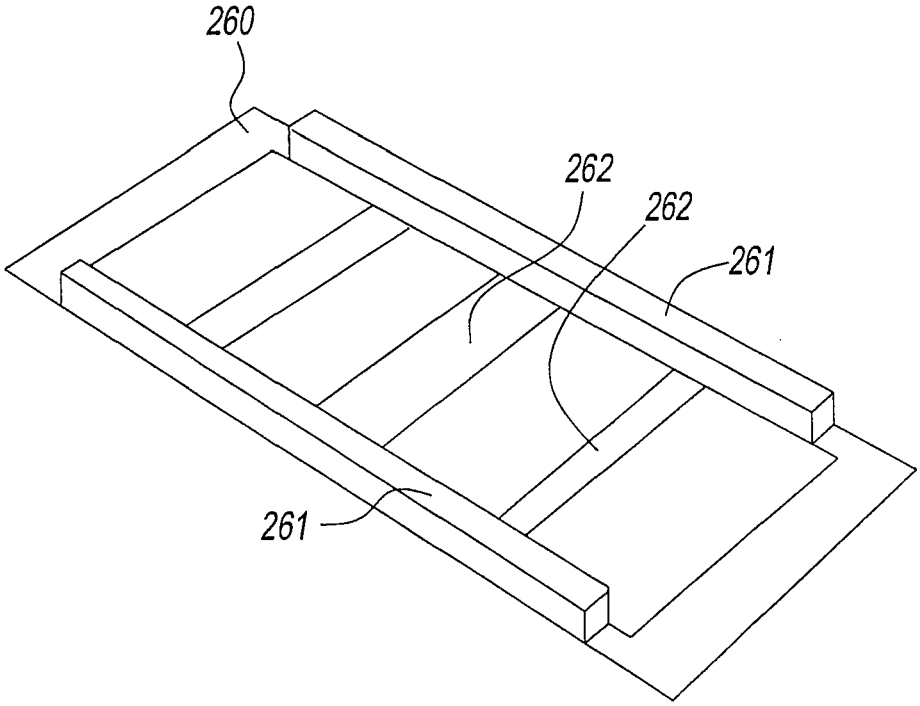
FIG. 19 illustrates a top perspective view of a stabilizing base component of the sixth and seventh embodiments of the present disclosure.

Adjacent appendage members 320 are connected by straps 330 to ensure proper alignment during assembly and prior to installation at the site. Additionally, base components 335 connect adjacent appendage members and are identical to the base components of FIG. 19. Base components 335 prevent central effluent chamber 305 and appendage members 320 from sinking into surrounding soil in leeching field particularly when soil is saturated with effluent. Base components 335, like straps 330, ensure that proper alignment is maintained between appendages 320 and effluent chamber 305 during assembly and after installation.

Disposed over the entire top portion of central effluent chamber 300 is a pipe or channel 340. Pipe 340 has an inverted U-shaped configuration. Pipe 340 is approximately 2 inches in height and approximately 6 inches in width to fit over effluent chamber 305. Pipe 340 is made from a material that is impervious to the effluent and is preferably, nylon, ABS or PVC, although other similar materials could also be used. Disposed over system 300 is a filter fabric to prevent soil from entering effluent chamber and appendages 340.

Figure 20:
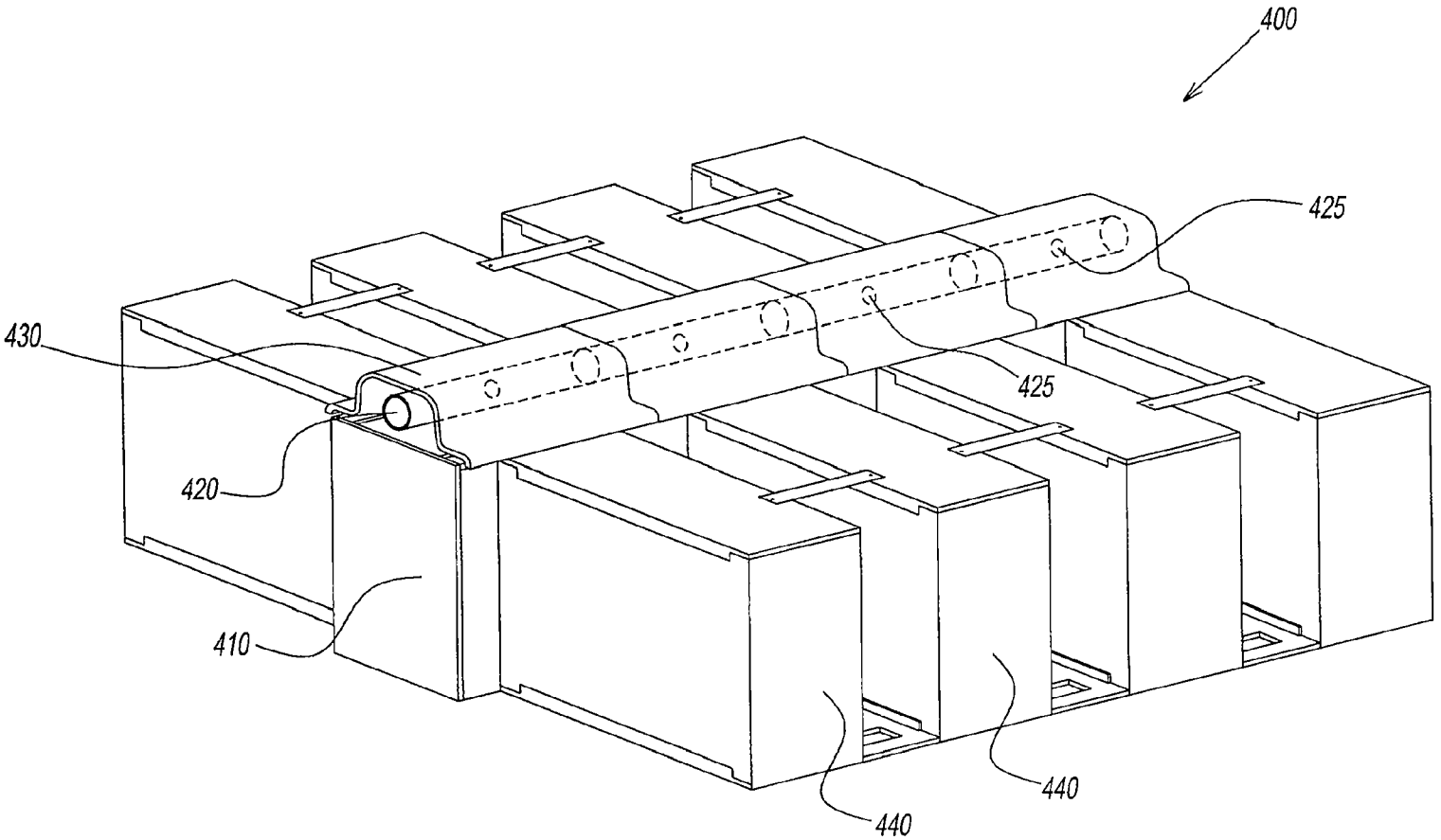
FIG. 20 illustrates a perspective view of a collection chamber according to an eight embodiment of the present disclosure.
Figure 21:
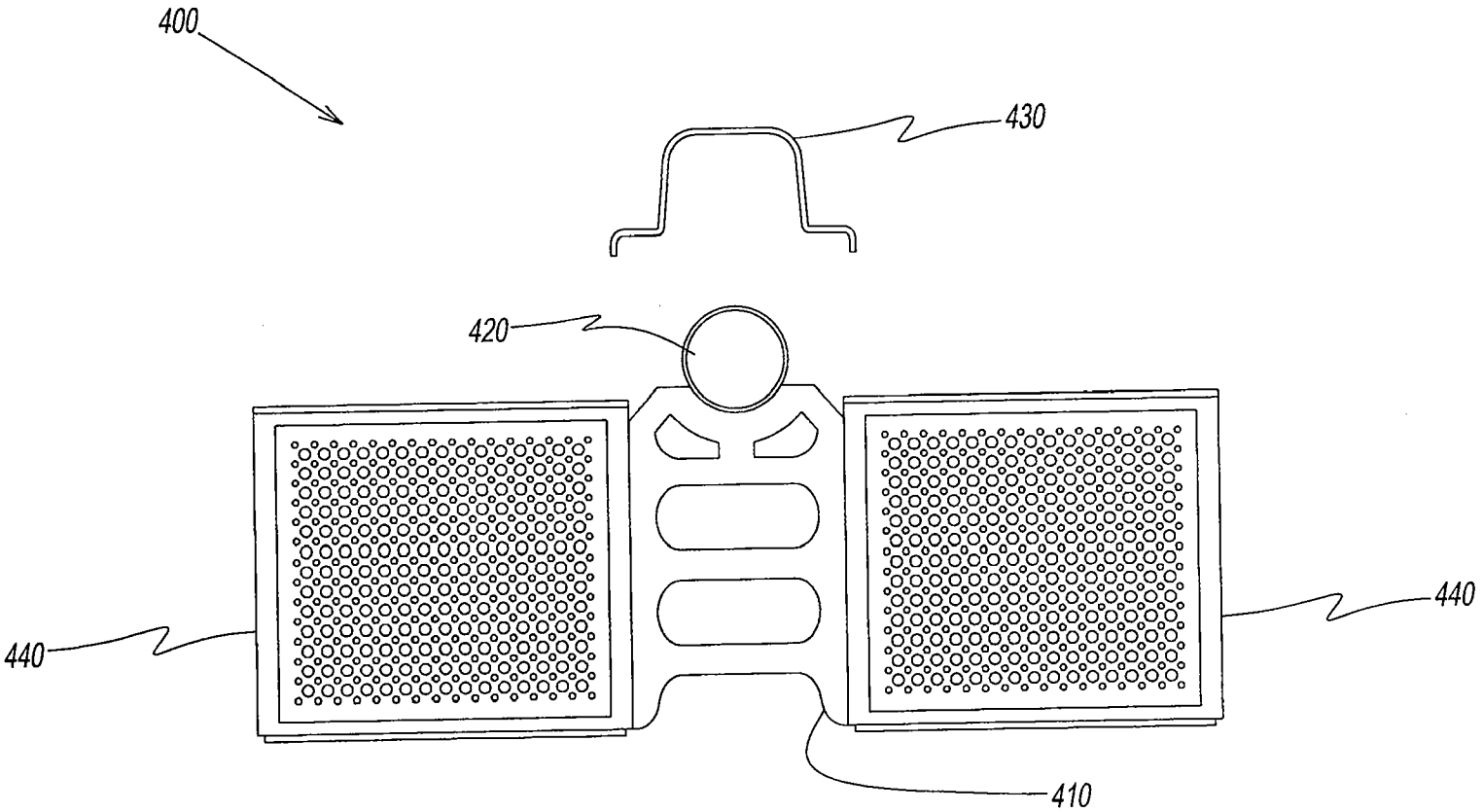
FIG. 21 illustrates a side view of the collection chamber of FIG. 20.

The eighth embodiment as shown in FIGS. 20 and 21, provides a system 400 that is an entirely plastic system. System 400 has a central conduit 410 that supports a pipe 420 which is covered by cover 430. Pipe 420 rests on top of conduit 410. Cover 430 protects pipe 420 from the weight of the earth and distributes weight of earth so that such weight is not borne by pipe 410. Appendages 440 are connected to opposite sides of central conduit 410 such as shown in earlier embodiments. Cover 430 is preferably connected to upper surface of conduit 410, such as by snap fitting.

System 400 shows cover 430 positioned above appendages, for purposes of clarity, in which has a plurality of segments 435 are joined to form cover 430. Pipe 420 contains perforations 425 on it underside to feed effluent into central conduit 410. Central conduit 410 has openings on a top thereof such as shown in FIG. 18 in segments 325. By having multiple perforations 425, distribution of effluent into conduit 410 at different locations is ensured. Alternatively, portions of pipe 420 that are further from locations where effluent enters pipe 420 may have a greater number of perforations to ensure even distribution of effluent in central conduit 410 along length of pipe 420.

Figure 22:
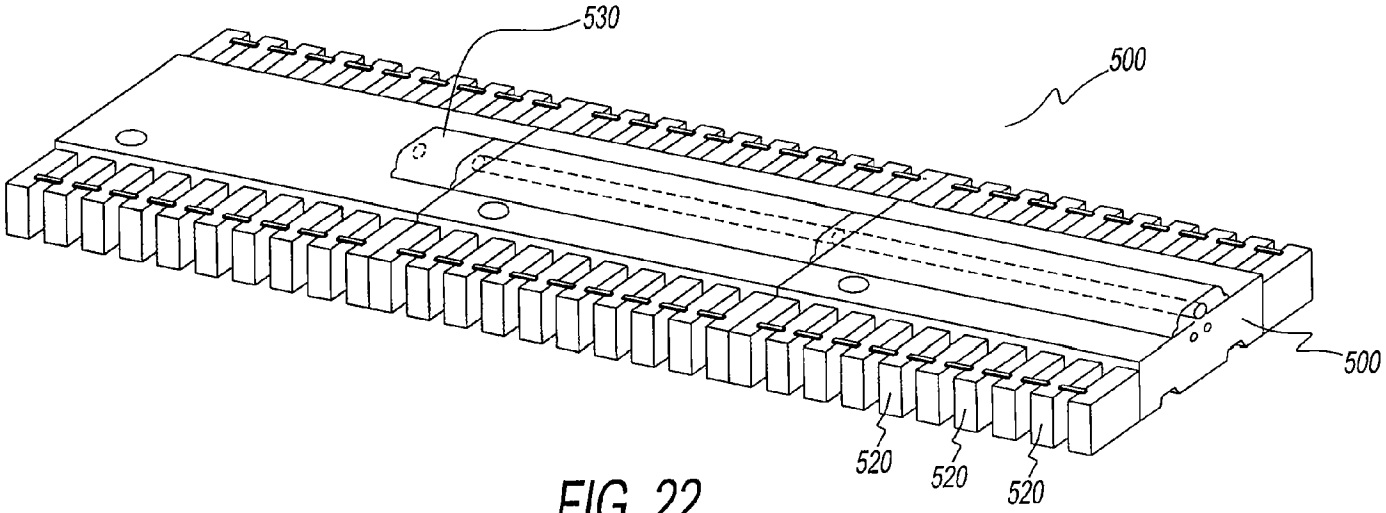
FIG. 22 illustrates a perspective view of an alternative collection chamber of FIG. 20 having a cement collection chamber.
Figure 23:
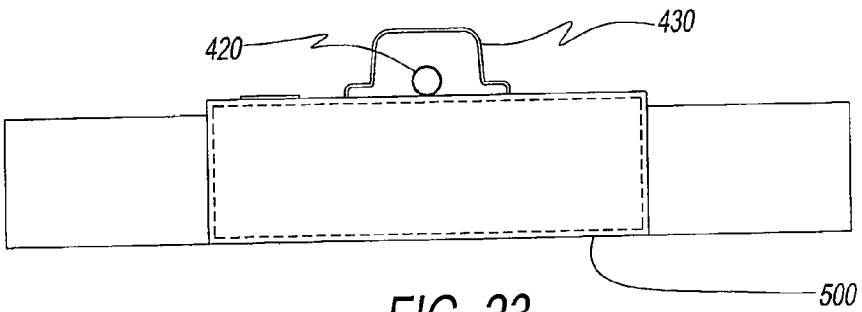
FIG. 23 illustrates a side view of the chamber of FIG. 22.

A system 500 of FIGS. 22 and 23 is a further embodiment that shows cover 530 and pipe 520 connected to a cement gallery 500. Pipe 520 has perforation on a lower side thereof to deposit effluent into gallery 500. Gallery 500 has a plurality of appendages connected thereto, such as shown in earlier embodiments to facilitate distribution of effluent into surrounding leeching field from pipe 520. Pipe 520 is located above or on top of gallery 500 instead of inside of gallery as shown in FIGS. 16 and 17. By having pipe 520 on top of gallery 500, capacity of gallery to hold effluent from pipe 520 is maximized. Pipes 222 of FIGS. 16 and 17 reduce capacity of gallery by approximately one quarter to one third because of the volume of cement that was required to maintain structure of pipes.

It should be understood that the foregoing description is only illustrative of the present disclosure. Various alternatives and modifications can be devised by those skilled in the art without departing from the scope of the present disclosure. Accordingly, the present disclosure is intended to embrace all such alternatives, modifications and variances.

What is claimed is:

1. A modular system for a fluid collection chamber installed in the ground and for dispersion of fluid, the fluid collection chamber having a first lateral side with a second surface area and a second lateral side with a third surface area, the modular system comprising:

a first modular appendage for connection to the first lateral side of the chamber, said first modular appendage comprising a first surface having portions that are coplanar and perpendicular to the lateral side and form a plurality of shaped members, said first surface having a first surface area greater in value than the second surface area of the fluid collection chamber.

2. The modular system of claim 1, wherein said first modular appendage may be stacked horizontally and connected to another second modular section.

3. The modular system of claim 1, wherein said first modular appendage may be stacked vertically and connected to another second modular appendage.

4. The modular system of claim 1, wherein said first modular appendage forms a plurality of four-sided members that each has a pair of parallel sides that perpendicularly extend from the first lateral side, and a facing side that is perpendicular to each side of said pair of parallel sides and a top that connects each of said pair of parallel sides.

5. The modular system of claim 4, wherein said facing side is parallel to said first lateral side.

6. The modular system of claim 1, wherein said first modular appendage is made from a plastic resin material selected from the group consisting of resilient thermoplastic, polycarbonate, polyvinyl chloride, acrylonitrile-butadiene-styrene, polyurethane, acrylic resin, and any combinations thereof.

7. The modular system of claim 1, wherein said first modular appendage comprises a plurality of shaped members including a first shaped member and a second shaped member that are connected by a plate, wherein said plate is in contact with the first lateral side of said fluid collection chamber and a space exists between said first shaped member and said second shaped member, said space being suitable to have earth disposed therein.

8. The modular system of claim 7, wherein the earth is selected from the group consisting of a filtering medium, sand, dirt, rock, gravel, an organic medium, an inorganic medium, an insulating material, and any combinations thereof.

9. The modular system of claim 1, further comprising a plurality of protuberances that extend in a direction perpendicular to said portions.

10. The modular system of claim 9, wherein each of said plurality of protuberances has a length of approximately from 0.25 inches to 0.50 inches.

11. The modular system of claim 1, further comprising a second modular appendage comprising a fourth surface having portions that are coplanar and perpendicular to the second lateral side and form a plurality of members, the fourth surface having a fourth surface area greater in value than the third surface area of the chamber, wherein said second modular section forms a plurality of four-sided members that each has a pair of parallel sides and a facing side that is perpendicular to each side of said pair of parallel sides.

12. The modular system of claim 11, further comprising a plurality of apertures in said fourth surface for passage of fluid from the fluid collection chamber through said plurality of apertures.

13. The modular system of claim 1, further comprising a plurality of apertures in said first surface area for passage of fluid from the fluid collection chamber through said plurality of apertures.

14. A fluid dispersion system disposed in the earth for dispersing fluid from a fluid source to a leaching field in the earth, the system comprising:

a fluid collection chamber having a first planar lateral side with a second surface area and second planar lateral side with a third surface area;

a plurality of members that are in fluid communication with and extend from said first planar lateral side of said fluid collection chamber, wherein said plurality of members comprise a first surface having a first surface area greater in value than said second surface area of the fluid collection chamber, and wherein said first surface has a plurality of apertures to permit fluid to flow into the earth; and a conduit in fluid communication with said fluid collection chamber to receive fluid from the fluid source.

15. The fluid dispersion system according to claim 14, further comprising a second plurality of members that are in fluid communication with and extend from said second planar lateral side of said fluid collection chamber, wherein said second plurality of members comprise a fourth surface having a fourth surface area greater in value than said third surface area of the fluid collection chamber, and wherein said fourth surface has a plurality of apertures to permit fluid to flow into the earth from the fluid source.

16. The fluid dispersion system according to claim 15, wherein said each of said first plurality of members and each of said second plurality of members comprise two parallel sides, a top surface that connects said two parallel sides, and a facing surface that perpendicular to said top surface and connects said two parallel sides, wherein each of said first plurality of members extend perpendicularly from said first planar lateral side and said second plurality of members extend perpendicularly from a second planar lateral side of said fluid collection chamber to extend into the leaching field in the surrounding earth.

17. The modular appendage of claim 14, wherein the leaching field is a filtering material that is selected from the group consisting of sand, dirt, rocks, gravel, an organic medium, an inorganic medium, an insulating material, and any combinations thereof.

18. The fluid dispersion system of claim 16, wherein each of said first plurality of members and each of said second plurality of members are spaced from an adjacent member to extend into the leaching field.

19. The fluid dispersion system of claim 14, further comprising a third plurality of members for connection to a third side of said fluid collection chamber that is perpendicular to said first side and said second side.

20. The fluid dispersion system of claim 15, wherein each of said first plurality of members and each of said second plurality of members has a parallelepiped shape and is hollow inside.

21. The fluid dispersion system of claim 14, further comprising apertures in said conduit to permit fluid to flow from the fluid source into said collection chamber.

22. The fluid dispersion system of claim 14, further comprising a cover disposed over said conduit and connected to said fluid collection chamber to protect said conduit from the earth.

23. The fluid dispersion system of claim 14, wherein each of said plurality of protuberances extend in a direction perpendicular to said first surface and from said fourth surface.

24. The fluid dispersion system of claim 23, wherein each of said plurality of protuberances has a length of approximately from 0.25 inches to 0.50 inches.

25. The fluid dispersion system of claim 14, wherein said collection chamber comprises a horizontal surface between said first lateral side and said second lateral side that supports said conduit, wherein said horizontal surface supports said conduit.

26. The fluid dispersion system of claim 14, wherein said fluid collection chamber is selected from the group consisting of a gallery and a narrow channel.

27. The fluid dispersion system of claim 15, wherein said first plurality of members and said second plurality of members, said fluid collection chamber, and said conduit are made from a plastic resin material selected from the group consisting of resilient thermoplastic, polycarbonate, polyvinyl chloride, acrylonitrile-butadiene-styrene, polyurethane and acrylic resin, and any combinations thereof.

28. A fluid dispersion system disposed in the earth for dispersing fluid from a fluid source to a leaching field in the earth, the system comprising:

a fluid collection chamber having a lateral side;

an appendage in fluid communication with and extending from said lateral side to disperse fluid from the fluid collection chamber to the leeching leaching field; and a conduit in fluid communication with said appendage to receive effluent from the fluid source, wherein said lateral side comprises a first planar lateral side with a second surface area; and wherein said appendage comprises a plurality of members that comprise a first surface having a first surface area greater in value than said second surface area of the fluid collection chamber, and wherein said first surface has a plurality of apertures to permit fluid to flow into the earth.

29. The fluid dispersion system according to claim 28, wherein each of said plurality of members has parallelepiped shape and is hollow inside.

30. The fluid dispersion system of claim 28, further comprising apertures in said conduit to permit fluid to flow from the fluid source into said appendage.

31. The fluid dispersion system of claim 28, wherein said conduit is a pipe.

32. The fluid dispersion system of claim 28, wherein each of said plurality members further comprise protuberances.

33. The fluid dispersion system of claim 32, wherein each of said plurality of protuberances has a length of approximately from 0.25 inches to 0.50 inches.

* * * * *